US005622211A

United States Patent [19]

Martin et al.

[11] Patent Number: 5,622,211

[45] Date of Patent: Apr. 22, 1997

[54] PREPERFORATED COILED TUBING

[75] Inventors: John R. Martin, Houston; Martin B. Robertson, Jr., Bay City, both of Tex.

[73] Assignee: Quality Tubing, Inc., Houston, Tex.

[21] Appl. No.: 479,153

[22] Filed: Jun. 7, 1995

Related U.S. Application Data

[62] Division of Ser. No. 268,628, Jun. 30, 1994, Pat. No. 5,526,881.

[51] Int. Cl.[6] ..... E21B 43/10

[52] U.S. Cl. ..... 138/177; 138/89; 138/103; 166/296

[58] Field of Search ..... 138/89, 103, 177, 138/178; 239/533.13; 166/276, 278, 296

[56] References Cited

U.S. PATENT DOCUMENTS

| | | | |
|---|---|---|---|
| 395,034 | 12/1888 | Coffin . | |
| 535,390 | 3/1895 | Murphy | 138/89 X |
| 958,100 | 5/1910 | Decker . | |
| 2,185,522 | 1/1940 | Rollins . | |
| 3,036,782 | 5/1962 | Windsor | 239/533.13 X |
| 3,216,497 | 11/1965 | Howard et al. . | |
| 3,273,641 | 9/1966 | Bourne . | |
| 3,333,635 | 8/1967 | Crawford . | |
| 3,360,047 | 12/1967 | Burnett . | |
| 3,390,724 | 7/1968 | Caldwell . | |
| 3,434,537 | 3/1969 | Zandmer . | |
| 3,693,888 | 9/1972 | Rondas et al. | 239/535 |
| 3,980;104 | 9/1976 | Kabai | 138/177 X |
| 4,018,282 | 4/1977 | Graham et al. . | |
| 4,018,283 | 4/1977 | Watkins . | |
| 4,077,570 | 3/1978 | Harmony | 239/533.13 X |
| 4,142,663 | 3/1979 | Blatnik et al. . | |
| 4,214,945 | 7/1980 | Lucas et al. . | |
| 4,380,318 | 4/1983 | Curry | 239/533.13 |
| 4,406,326 | 9/1983 | Wagner . | |
| 4,498,543 | 2/1985 | Pye et al. . | |
| 4,574,443 | 3/1986 | Persak et al. . | |
| 4,860,831 | 8/1989 | Caillier . | |
| 4,863,091 | 9/1989 | Dubois . | |
| 5,191,911 | 3/1993 | Dubois . | |
| 5,228,518 | 7/1993 | Wilson et al. . | |
| 5,320,460 | 6/1994 | Murakami et al. | 138/89 X |
| 5,355,956 | 10/1994 | Restarick . | |

*Primary Examiner*—Patrick Brinson
*Attorney, Agent, or Firm*—Fish & Richardson, P.C.

[57] ABSTRACT

Preperforated tubing is produced by forming a perforation in flat strip of raw material, forming a hollow, cylindrical tube from the flat strip, and placing a removable plug into the perforation, so as to form a fluid-tight seal. A sealing element may be placed into the perforation. The perforation may comprise a hole, into which first and second countersinks may be formed. The sealing element may be placed into the first countersink, and the plug may be placed through the countersinks and the hole, such that the plug's body fills the hole and the plug's head fits within the second countersink.

6 Claims, 4 Drawing Sheets

FIG. 1
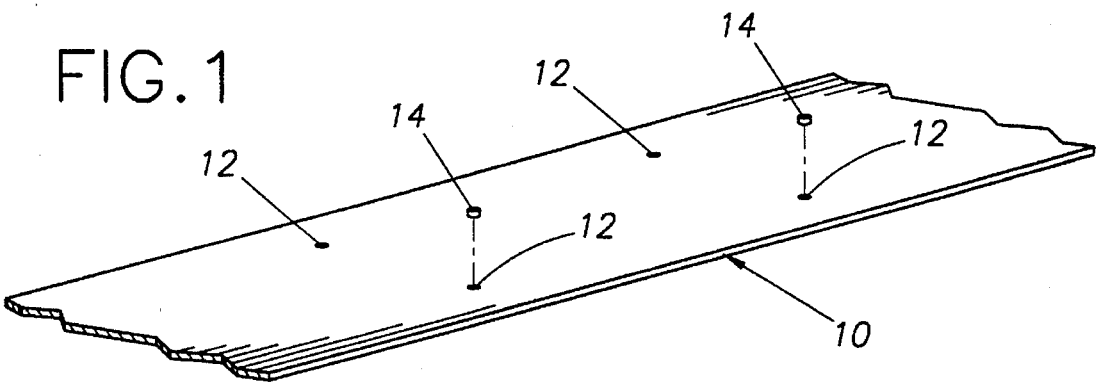
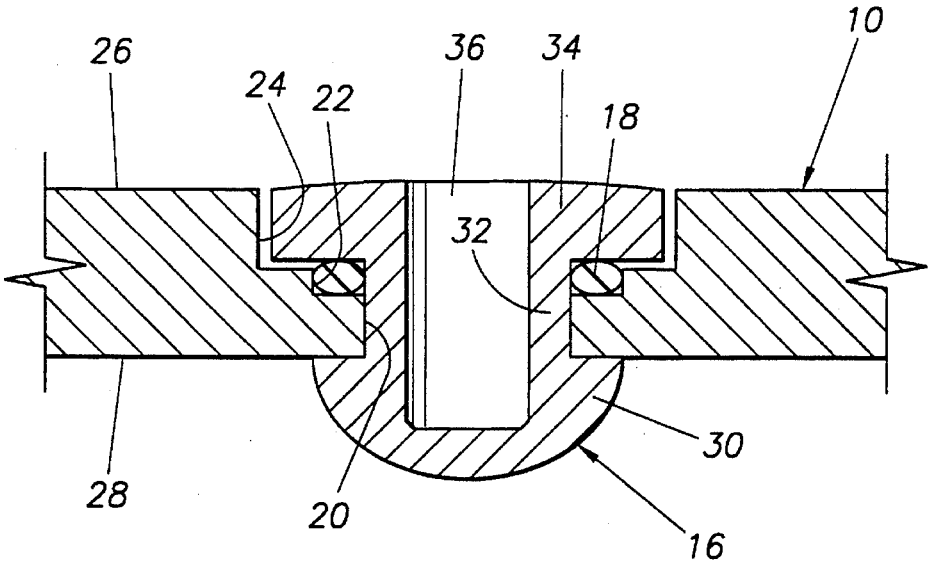
FIG. 2
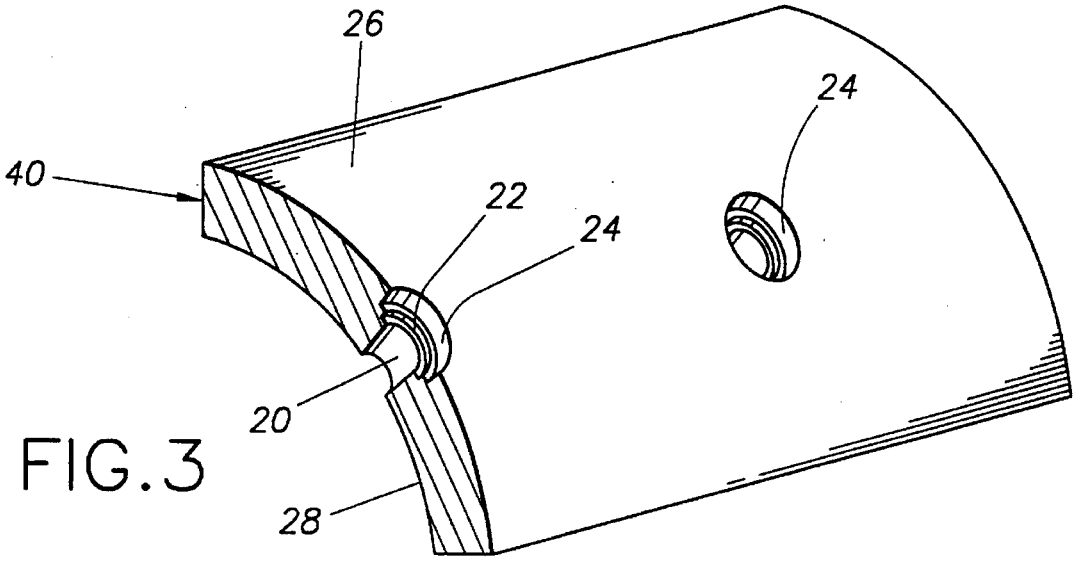
FIG. 3

PREPERFORATED COILED TUBING

This is a divisional of application Ser. No. 08/268,628, filed Jun. 30, 1994 now U.S. Pat. No. 5,526,881.

BACKGROUND OF THE INVENTION

The invention relates to coiled tubing and, in particular, to preperforated coiled tubing.

Conventional down-hole oil and gas drilling and production techniques require solid casings or liners which maintain the integrity of a well and contain certain drilling fluids. Referring to FIG. 7A, when drilling is complete and the casing or liner 102 is in place, the casing or liner 102, or tubing (not shown), is used to produce hydrocarbons from the pay zone 100 to the surface 101. As a result, the casing 102 must be pierced at this location to allow hydrocarbons to flow into and up the casing 102. This can be accomplished by lowering high energy shaped charges or bullets 104 into the well and firing them through the casing into the formation. However, piercing the casing in this manner contaminates, and sometimes damages, the formation.

Alternatively, referring to FIG. 7B, the casing 102 may be preconditioned in certain areas to selectively allow production through the wall of the casing 102. According to one known type of preconditioning, holes 106 are drilled into the casing 102 before the casing is lowered into the well. Plugs 108 are then placed into the holes to prevent oil or gas from prematurely entering the casing. When the casing 102 is finally positioned in the well and hydrocarbons are to be produced from an area above the pay zone 100, the plugs 108 are removed from the holes 106 either by grinding or by dissolving with a chemical agent.

A disadvantage of conventional perforation methods is that it is necessary to drill a large number of holes in the round walls of the casing. This task is labor intensive and very expensive. In addition, conventional plugging techniques are prone to undesired leakage.

In recent years, coiled tubing has been used in lieu of, or in addition to, conventional casings or liners during oil and gas drilling and production operations. Referring to FIG. 8, coiled tubing 110 comprises a long length of metal tubing on a spool 112. The tubing can be wound and unwound into the well, thus eliminating the need to piece together sections of straight pipe. In order to produce hydrocarbons from the well, coiled tubing must be pierced with bullets or shaped charges, as described above.

SUMMARY OF THE INVENTION

The invention provides preperforated tubing in which quick, easy, low-cost perforation of the tubing material is possible. The invention, in the preferred form, is used in conjunction with coiled tubing. However, it is within the scope of the invention to provide preperforated straight tubing, such as that which may be retrofitted to an end of a length of coiled tubing or connected between two lengths of coiled tubing. The invention also provides preperforated coiled tubing in which the perforation plugs can withstand repeated coiling and uncoiling stresses without leaking.

In one aspect of the invention, a method of producing preperforated tubing comprises the steps of forming at least one perforation in a flat strip of raw material, forming a substantially hollow, cylindrical tube from the flat strip, and placing a removable plug in the perforation so as to form a fluid-tight seal. In another aspect, a sealing element is applied to the perforation.

In another aspect of the invention, a method of perforating tubing comprises the steps of forming a substantially circular hole in a section of tubing material; forming about the hole a first countersink having a first diameter and a first depth, the first countersink being substantially concentric with the hole; forming about the hole a second countersink having a second diameter and a second depth, the second countersink being substantially concentric with the first countersink and the hole, the second diameter being larger than the first diameter, and the second depth being smaller than the first depth; placing a sealing element substantially within the first countersink; and inserting a plug through the first and second countersinks and the hole; wherein a body of the plug substantially fills the hole and a head of the plug fits substantially within the second countersink, and wherein the sealing element and the plug cooperatively form a fluid-tight seal between an inner surface and an outer surface of the tubing material. In another aspect, the tubing material comprises a section of hollow cylindrical tubing. In still another aspect, the tubing material comprises a section of flat strip, and the method further comprises the step of forming a tube from the flat strip.

In another aspect of the invention, a preperforated tube is formed from a flat strip of raw material, the flat strip of raw material comprising at least one perforation and a plug inserted through the perforation. In another aspect, the preperforated tube further comprises a sealing element disposed between the perforation and the plug.

In another aspect of the invention, a length of coiled tubing comprises a wall having an inner surface and an outer surface, a perforation adapted to selectively place the outer surface of the wall in fluid communication with the inner surface of the wall, and a plug inserted into the perforation. In another aspect, the perforation comprises a double-countersunk hole.

In still another aspect of the invention, a method of preperforating a tube comprises the steps of forming an eccentric perforation in a flat strip of raw material; connecting a plurality of strips to form a composite strip; and forming a tube from the composite strip; wherein the eccentric perforation is shaped to create a substantially circular aperture by compensating for tube-forming stresses. In a further aspect, the perforation comprises a plurality of oblong bevels, the oblong bevels being shaped to form a substantially circular, double-countersunk aperture by compensating for tube-forming stresses.

In another aspect of the invention, a method of achieving fluid communication between an outer surface and an inner surface of downhole tubing comprises the steps of conditioning a flat strip of raw material at predetermined areas; forming the flat strip into tubing; running the tubing downhole without fluid communication between the outer surface and the inner surface at the conditioned areas; positioning the tubing in a predetermined downhole orientation; and selectively establishing fluid communication between the inner surface and the outer surface of the tubing at the conditioned areas. In another aspect, the conditioned areas comprise perforations formed in the flat strip of raw material.

In another aspect of the invention, a method of perforating a length of tubing comprises the steps of creating a plurality of perforations in a flat strip of raw material having characteristic inconsistencies, each of said perforations located at a corresponding area within the flat strip, said perforations uniquely formed according to the characteristic inconsistencies of the flat strip at the corresponding area; forming a substantially hollow, cylindrical tube from the flat strip of raw material; and inserting a plurality of plugs into the perforations; wherein all of the perforations have substantially similar shape after forming the tube from the flat strip.

BRIEF DESCRIPTION OF THE DRAWINGS

Particular embodiments of the invention are described in detail herein with reference to the following drawings:

FIG. 1 shows a section of perforated strip material according to one embodiment of the invention;

FIG. 2 shows a perforation, plug and seal in a strip according to one embodiment of the invention;

FIG. 3 shows the deformation of perforations which occurs when the strip of FIG. 2 is formed into tubing;

DESCRIPTION OF THE PREFERRED EMBODIMENTS

Figure 4A:
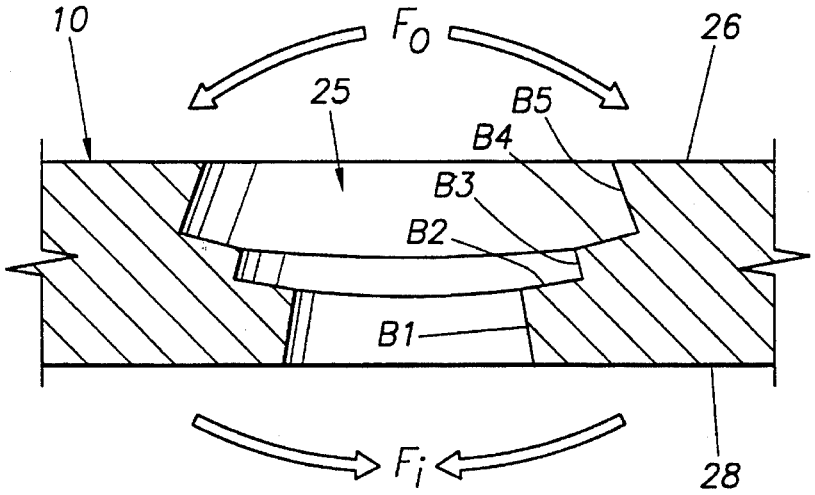
FIGS. 4A through 4C show a perforation formed in a strip of raw material according to another embodiment of the invention.
Figure 4B:
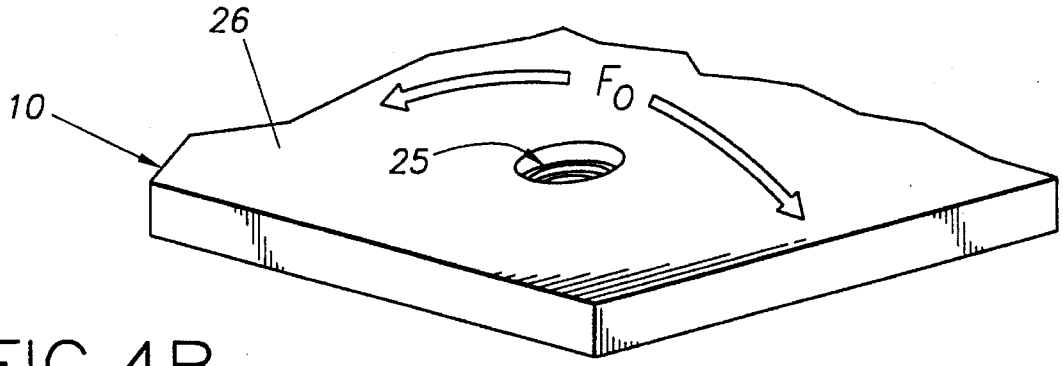

As discussed above, downhole casings or straight tubing may be preconditioned in certain areas to allow production through the casing or tubing walls. In fact, several means for preconditioning production tubing are known. To date, however, preconditioning techniques have been insufficient and applicable only to casings or straight tubing already formed from raw material.

Referring to FIG. 1, a flat sheet ("strip") 10 of skelp raw material, preferably steel, is used to produce tubing. Round perforations 12 are formed in the strip 10 using any suitable means, such as drilling or, preferably, punching. Drilling in the flat is much easier and less expensive than drilling "in the round" once the tubing has been formed. Punching is even more economical, but previously was not used because it can only be done in the flat. The perforations are then plugged in a manner described in detail below.

Once the perforations are formed and plugged, several of the strips are welded together, preferably at a bias of 45°, to form a composite strip having a desired length. Tubing is formed from the composite strip by running the strip through a tube mill. If coiled tubing is desired, the tubing is then coiled onto a spool. The process of forming coiled tubing from a composite strip is described in detail in U.S. Pat. Nos. 4,863,091 and 5,191,911, the disclosures of which are hereby incorporated by reference.

Because the tubing may come in countless sizes and thicknesses, the strip 10 may be of any possible dimension. In the preferred embodiment, the diameter of the tubing is between approximately 2.375" and 3.5", and the wall thickness is between approximately 0.150" and 0.210". The dimensions of the strip 10 are determined accordingly. The perforations 12 may also appear in numerous sizes and patterns, depending upon the application for which the tubing will ultimately be used. In the preferred embodiment, the perforations 12 are circular, having a diameter of 0.375", and are positioned such that the resultant tubing comprises approximately 0.25 $in^2$ of perforation per one foot of tubing.

Referring to FIG. 2, the preferred perforation is a double-countersunk hole formed in the strip 10. To form this hole, a circular hole 20 is punched into the strip 10. A countersink 22 is then drilled into the hole, and a second countersink 24 is drilled into the first countersink 22. The hole 20, the first countersink 22, and the second countersink 24 have increasing diameter and decreasing depth; in other words, the second countersink 24 is wider and shallower than the first countersink 22, which is in turn wider and shallower than the hole 20. In the preferred embodiment, a 0.25" diameter circular hole 20 is punched through the strip 10, which has a thickness of 0.175". Circular countersinks 22 and 24 are formed in and are concentric with the hole 20. Countersink 24 has a diameter of 0.505" and extends to a depth of 0.095" below the outer surface 26 of the strip 10, while countersink 22 has a diameter of 0.375" and extends 0.030" beyond countersink 24 (i.e., to a depth of 0.125" below the outer surface 26).

Referring again to FIG. 1, removable plugs 14 are placed within the perforations 12 in the strip 10. The plugs 14 preferably fit into the perforations 12 in a manner which maintains the smooth cylindrical finish of the tubing. In other words, the plugs 14 should not extend significantly above the "outer" surface of the strip 10, i.e., the surface which will form the outer surface of the tubing. The plugs 14 should also be of sufficient size to fit snugly within the perforations 12. The preferred plugs are also discussed in more detail below.

Also placed within each perforation 12 is a sealing element (not shown in FIG. 1), which, in conjunction with the plug 14, creates a fluid-tight seal between the surfaces of the tubing created from the strip 10. The sealing element may assume many forms, including, but not limited to, fabric washers, chemical compounds, flexible rings, and polytetrafluoroethylene (PTFE). It is also possible to use a pressure-responsive seal, one whose sealing characteristics improve as pressure is increased. Regardless of the type of sealing element used, the perforated tubing must be able to withstand extremely high internal and external pressures, as well as repeated coiling and uncoiling stresses. In the preferred embodiment, the plugged and sealed perforations must be able to withstand a minimum pressure of 2000 psi, and at least eight coiling/uncoiling cycles.

Referring again to FIG. 2, the preferred plug 16 and sealing element 18 are placed within the perforation. The preferred plug 16 is a hollow-head, closed-end button rivet, such as the "Klik-Fast" rivet produced by Marson Corporation (Model No. AB8-4CLD). Other embodiments may include plugs designed specifically for perforated tubing systems, such as the "EZ-Trip" manufactured by Stirling Design International. The preferred sealing element 18 is a rubber O-ring, available from any manufacturer of commercial sealing rings.

The rubber O-ring 18 is placed within countersink 22, while the rivet 16 is inserted from the outer surface 26, through countersinks 22 and 24, and through the hole 20. When the rivet is properly installed, the button-end 30 overlaps the hole 20 and presses firmly against the "inner" surface 28 of the strip 10. In addition, the body 32 of the rivet 16 fills the hole 20, while the rivet head 34 fits into countersink 24. Countersink 24 is formed deep enough so that the rivet head 34 does not extend significantly beyond the outer surface 26. Furthermore, the O-ring 18 and the rivet 16 are forced or bound together in such a way that they cooperatively form a fluid-tight seal between the outer surface 26 and the inner surface 28 of the strip 10. The head 34 and body 32 of the rivet 16 contain a hollow channel 36, the purpose of which is described hereinbelow.

Referring to FIG. 3, when a strip of perforated material is milled to form a tube 40, tube-forming stresses act upon the perforations. As a result, the shapes of the holes 20 and the countersinks 22 and 24 are altered. As the strip bends, the circular holes and countersinks elongate, and they begin to taper from the outer surface 26 to the inner surface 28 of the tubing 40. If a rigid plug were used, this deformation of the hole would cause the plug to leak. This is why, in the prior art, perforations were always drilled in the round after the tubing had been formed. The plug and sealing element of the invention solve this problem by providing a flexible yet durable seal. Thus, the properties of the plug and sealing element must be sufficient to allow each to assume the shape of the distorted perforation. The rivet 16 is preferably made from a malleable metal, such as an aluminum or magnesium alloy. The O-ring 18 is preferably made from an elastic material, such as rubber. Other embodiments of the plug and sealing element may be necessary to withstand the tube-forming process. For example, a rivet which does not extend beyond the inner surface of the tubing may be needed to prevent damage during some tube-milling processes. The O-ring may need to be constructed of a more heat-resistant material.

When the tubing is coiled onto or uncoiled from a spool, coiling stresses, similar to the tube-forming stresses, act upon the perforations, plugs, and sealing elements. However, unlike the tube-forming stresses, which act upon the perforations around the longitudinal axis of the tubing, the coiling stresses occur along the longitudinal axis of the tubing, i.e., in the direction of coiling around the spool. As a result, the coiling forces cause additional deformation of the perforations. Because of the malleable and flexible qualities of the plug and sealing element of the invention, the plugged perforation more readily withstands these coiling forces.

In some embodiments, the rivet 16 and O-ring 18 may be inserted into the perforation after the tube is formed from the strip. For example, the rivet and O-ring may be forced into the distorted hole. Alternatively, the distorted hole may be milled to restore the hole to a generally circular shape, and the rivet and O-ring may be inserted therein.

In other embodiments, the preferred hole 20 and countersinks 22 and 24 may be formed in the tubing 40 instead of in the strip 10. In this case, the hole 20 is not subjected to the tube-forming stresses which occur when the tube is formed from the strip, and thus undergoes no deformation. The rivet 16 and O-ring 18 are placed into the undeformed perforation in the tube. In those embodiments concerning the production of coiled tubing, the perforation may be formed and plugged after forming the tubing from the strip, but prior to coiling it onto the spool. However, the plug must still be able to withstand repeated coiling and uncoiling stresses.

Referring to FIGS. 4A–4C and 5A–5B, an alternative perforation 25 is formed in the strip 10 in such a way that it has generally circular shape in the resultant tubing. As discussed above, when the strip 10 is curved to produce a section of tubing, tube-forming stresses alter the shape of the perforation 25. In particular, stress forces ($F_o$) on the outer surface 26 of the strip cause expansion of the perforation 25, while forces ($F_i$) on the inner surface 28 cause compression of the perforation. The amplitudes and directions of the tube-forming stresses will depend upon several factors, including, but not limited to, the type of material from which the strip 10 is produced, the thickness of the strip 10, and the diameter of the tubing 40 produced from the strip 10.

The structure of the perforation 25 must be sufficient to compensate for the tube-forming stresses expected to occur during formation of the corresponding section of tubing. To produce a generally circular double-countersunk perforation in the section of tubing (FIG. 5A), bevels B1 through B5 are formed in the strip 10. As shown in FIG. 4A, bevels B1, B3 and B5, which represent the sidewalls of the hole and the countersinks (20, 22 and 24 in FIG. 5A), taper outwardly from the outer surface 26 to the inner surface 28 of the strip 10. Likewise, bevels B2 and B4 taper inwardly from the outer surface 26 to the inner surface 28. The angle to which each bevel is cut depends upon the characteristics of the raw material and the tube-forming stresses that will occur. During formation of the tube 40, the tube-forming stresses act on the bevels such that bevels B1, B3 and B5 are parallel to each other and perpendicular to the surfaces of the tubing section 40, and bevels B2 and B4 are parallel to each other and the surfaces of the tube 40.

Figure 4C:
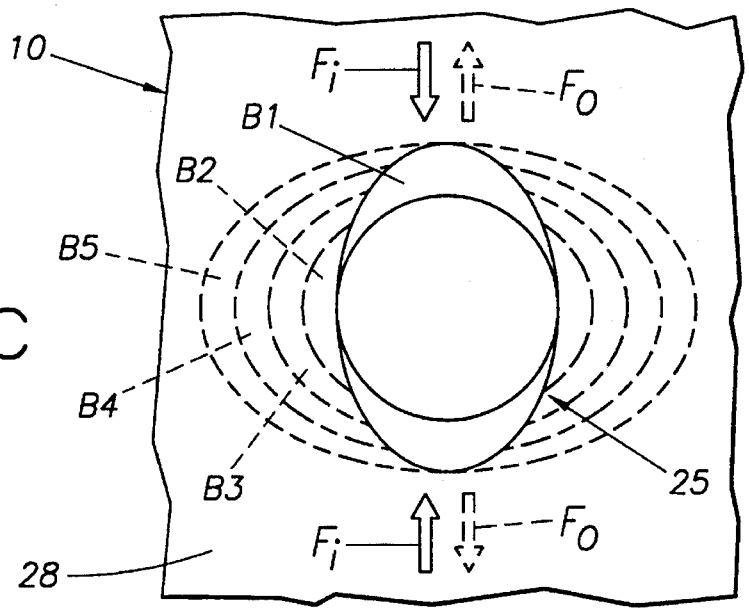

The bevels B1 through B5 are also formed such that they are variably rounded and oblong in shape. FIG. 4C (not to scale) depicts the perforation as viewed from the inner surface 28 of the strip 10, showing the varied geometry between the bevels. Bevel B5 lies closest to the outer surface 26, where the outer stress forces ($F_o$) cause the greatest expansion of the perforation. Therefore, bevel B5 is the most oblong of the bevels.

As the bevels approach the middle, but not necessarily the center, of the strip 10, the bevel shape is increasingly circular. At some point within the strip 10, again depending upon the characteristics of the raw material and the anticipated tube-forming stresses, the bevel shape is substantially circular. From this point, the bevels become increasingly oblong as they approach the inner surface 28 of the strip 10. More important, however, is the offset the bevels lying in the inner part of the strip have with respect to the bevels lying in the outer part of the strip. This offset ensures that the perforation tends to a generally circular shape as the inner stress forces ($F_i$) compress the inner bevels, while the outer stress forces ($F_o$) expand the outer bevels.

Figure 5A:
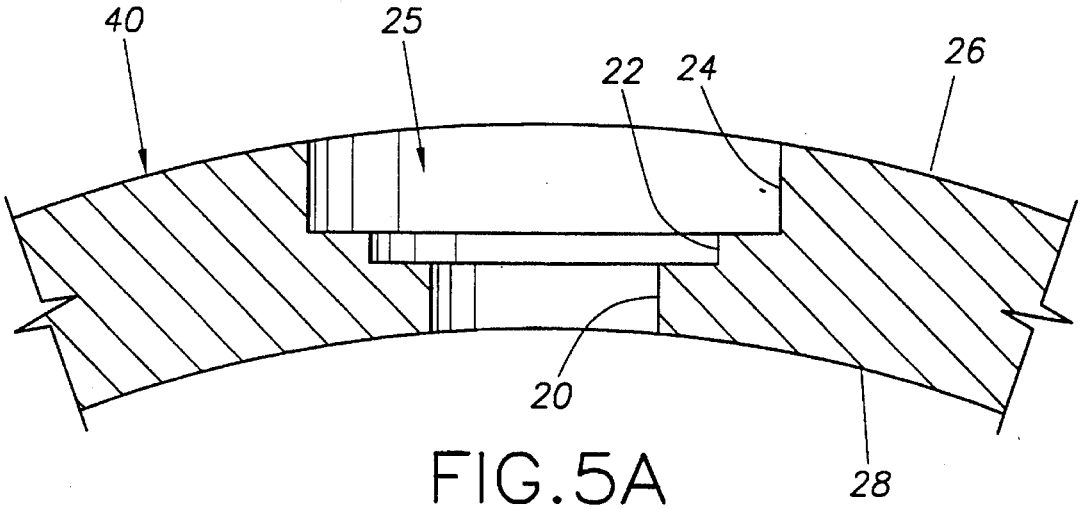
FIGS. 5A and 5B show a tubing section formed from the strip depicted in FIGS. 4A through 4C.
Figure 5B:
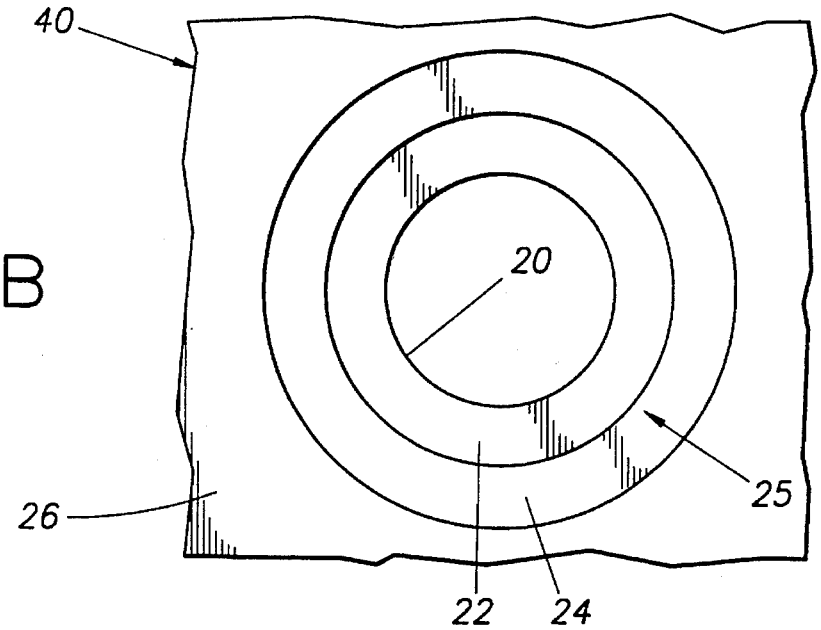

After the tube 40 is formed from end-welded strips 10, the perforation 25 comprises a hole 20 and countersinks 22 and 24 which are substantially cylindrical (FIGS. 5A and 5B). The perforation 25 is then sealed and plugged, as described above, and the tube can be spooled to form coiled tubing.

Figure 6:
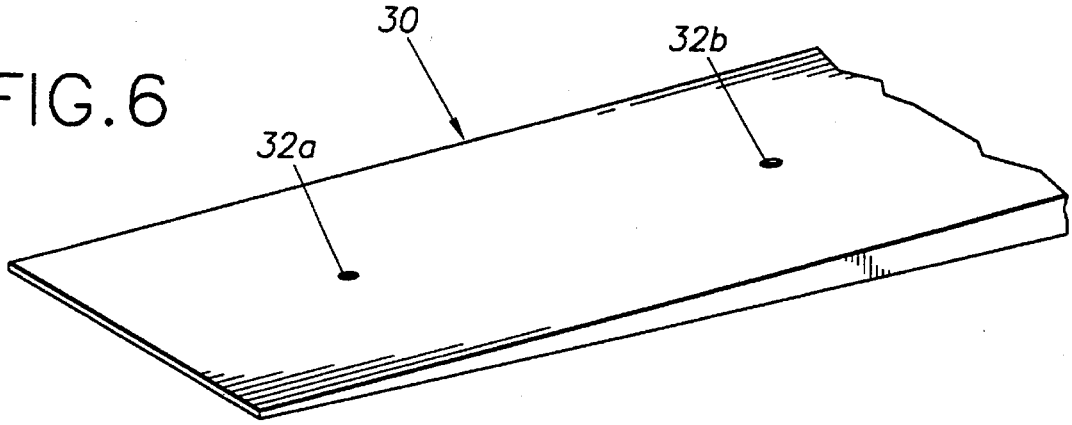
FIG. 6 shows a strip of raw material according to another embodiment of the invention.
Figure 7A:
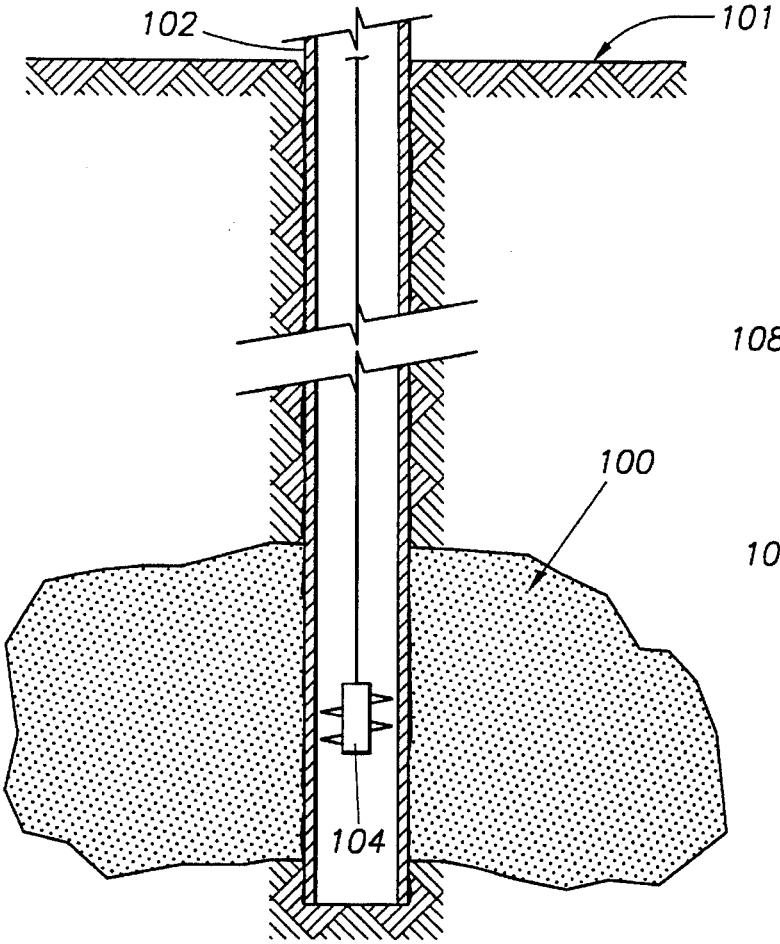
FIG. 7A (PRIOR ART)
FIGS. 7A and 7B show a conventional downhole casing or liner.
Figure 7B:
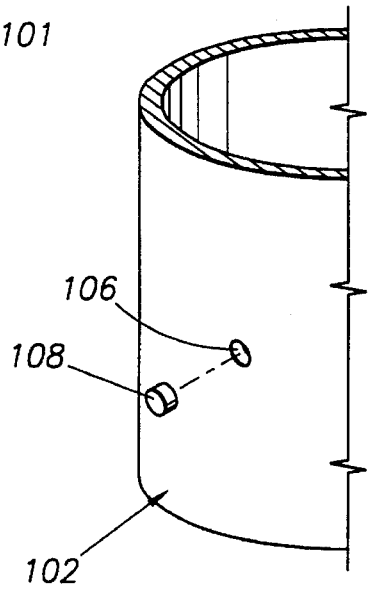
FIG. 7B (PRIOR ART)
Figure 8:
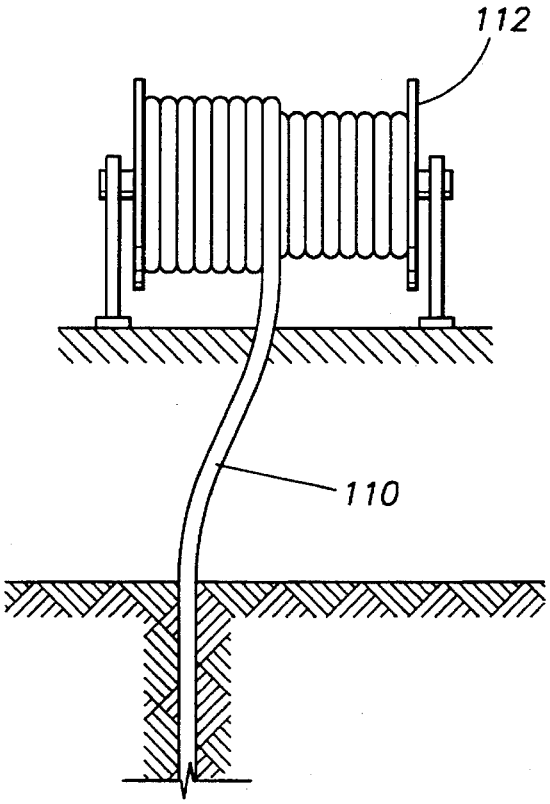
FIG. 8 (PRIOR ART)
FIG. 8 shows conventional coiled tubing.

Referring to FIG. 6, another embodiment of the flat strip 30 of raw material has nonuniform thickness throughout the length of the strip 30. There may also be inconsistencies in other characteristics of the material from which the strip 30 is formed, e.g., varying steel hardness or composition throughout the strip 30. In this case, each of the perforations **32*a* and 32*b* is uniquely formed according to the characteristics of the strip 30 at the area in which the perforation is located. Because of the inconsistencies in the strip 30, the tube-forming stresses on perforation 32*a* will differ from those on 32*b*, and the shapes of the punched perforations will vary accordingly. As a result, regardless of characteristic inconsistencies in the strip 30, the perforations 32*a* and 32*b* each will have generally circular shape after the strip 30** is milled into tubing.

Referring again to FIG. 2, when the perforations must be opened to produce hydrocarbons from a well, the rivet 16 is easily removed from the tubing by one of two methods. According to one method, the rivet 16 is dissolved by a chemical solution, such as an acid. For an aluminum or magnesium rivet, a solution of approximately 15% hydrochloric acid (HCl) is pumped into the tubing along its inner surface 28. When the solution reaches the rivet 16, the acid quickly dissolves the metal alloy, thereby opening the plugged perforation. Hydrocarbons from the well then enter the tubing for production at the surface.

Another removal method provides for grinding or milling the rivet to open the perforation. As described above, a hollow channel 36 runs through the head 34 and the body 32 of the rivet 16. The hollow channel 36 extends beyond the interior surface 28 of the tubing, and is closed by the button-end 30 of the rivet 16. In order to open the perforation, a downhole gauge reamer (not shown) is run internally through the tubing. When the reamer reaches the rivet 16, the cutting action of the reamer mills away the button-end 30, thereby exposing the hollow channel 36 and opening the perforation. Hydrocarbons from the well then flow into the tubing through the perforation for production at the surface.

Preferred embodiments of the invention have been described in detail. However, the invention is not so limited. Rather, the invention is limited only by the scope of the following claims.

What is claimed is:

1. A length of tubing, comprising:

a wall having an inner surface and an outer surface;

a perforation adapted to selectively place the outer surface of the wall in fluid communication with the inner surface of the wall, said perforation comprising a hole having a first countersink and a second countersink, being concentric with and wider than said first countersink;

a sealing element placed in said first countersink; and a plug inserted in said perforation, wherein a body of said plug substantially fills said hole and a head of said plug fits substantially within said second countersink, and wherein said sealing element and said plug cooperatively form a fluid-tight seal between the inner surface and the outer surface of the wall.

2. The length of tubing according to claim 1, wherein said plug and said sealing element comprise a pressure-responsive seal.

3. The length of tubing according to claim 2, wherein said seal responds to pressures internal and external to said coiled tubing.

4. The length of tubing according to claim 1, further comprising a plurality of said perforations each fitted with said sealing element and said plug.

5. The length of tubing according to claim 1, wherein the tubing is coiled tubing coiled on a spool.

6. The length of tubing according to claim 1, wherein a hollow channel is formed in said plug extending from the head at the outer surface of the wall to a distal end portion of the body located inwardly of the inner surface of the wall, wherein said hollow channel is closed at said distal end portion of the body to form said fluid-tight seal, and wherein said distal end portion of the body is selectively removable to place the outer surface of the wall in fluid communication with the inner surface of the wall via said hollow channel.

* * * * *